United States Patent [19]

Dietrich et al.

[11] 4,000,806

[45] Jan. 4, 1977

[54] APPARATUS FOR DESTACKING A SUBSTANTIALLY SPIRAL-SHAPED FORMED STACK OF PRINTED PRODUCTS

[75] Inventors: Felix Dietrich, Uster; Werner Honegger, Ruti, both of Switzerland

[73] Assignee: Ferag AG, Hinwil, Switzerland

[22] Filed: May 16, 1975

[21] Appl. No.: 578,040

[30] Foreign Application Priority Data

May 28, 1974 Switzerland ..... 7236/74

[52] U.S. Cl. ..... 198/443; 214/8.5 H; 271/109

[51] Int. Cl.[2] ..... B65G 59/00

[58] Field of Search ..... 198/35, 136, 105; 271/109; 214/8.5 H

[56] References Cited

UNITED STATES PATENTS 3,869,115 3/1975 Barkley ..... 198/165 X

*Primary Examiner*—John J. Love
*Assistant Examiner*—Douglas D. Watts
*Attorney, Agent, or Firm*—Werner W. Kleeman

[57] ABSTRACT

An apparatus for destacking a substantially spiral-shaped formed stack of printed products, wherein the printed products partially bear upon one another in overlapping formation. There is provided a stack support for the reception of the stack of printed products at its support surface means. Further, a rotational drive serves to place into rotation the stack of printed substantially spiral-shaped formed stack of printed products supported upon the stack support about the axis of the spiral, there being provided a stationary opening or throughpassage at the stack support following which there is arranged an outfeed conveyor.

9 Claims, 7 Drawing Figures

APPARATUS FOR DESTACKING A SUBSTANTIALLY SPIRAL-SHAPED FORMED STACK OF PRINTED PRODUCTS

BACKGROUND OF THE INVENTION

The present invention relates to a new and improved construction of apparatus for destacking or unstacking a substantially spiral-shaped formed stack of printed products wherein the printed products bear or contact one another in a partially overlapping arrangement.

Such a "spiral" or "spiral-shaped" stack is illustrated by way of example in FIG. 1 of this disclosure. Apart from the fact that such spiral-shaped stack, in comparison to a conventional stack, constitutes a completely different structure, owing to the spiral-shaped stack formation there are realized considerable practical advantages. A spiral-shaped stack of articles, typically printed products, in comparison to a conventional stack of printed products with the same number of such printed products and the same height, constitutes a uniform and stable structure, or, stated in another way, a spiral-shaped stack with the same stack height contains a greater multiplicity of printed products than a single, conventional stack.

As a general rule, stacks of printed products are directly formed from a so-called fish scale stream or arrangement of printed products, i.e. from a practically endless sequence of printed products which are conveyed in partially overlapping formation. Such a fish scale or imbricated arrangement of printed products or articles also forms an advantageous formation for the transport and further handling of the printed products, in contrast to stacks of such printed products which constitute the formation or arrangement suitable for the storage of the printed products. In the context of this disclosure it is to be understood that the description "fish scale" arrangement as used in connection with the articles which are conveyed, typically printed products, for instance newspapers, is intended to denote an arrangement of substantially flat structures or articles which are disposed in an overlying spread formation, in other words, in the manner of a fanned deck of cards. There are already known in this particular field of technology apparatuses which serve for transforming a fish scale arrangement of products into a conventional stack and, alternatively, for transforming a conventional stack into a fish scale stream or arrangement of such products. These apparatuses are in no way suitable for use in conjunction with a spiral-shaped stack, since the formation thereof is basically different from conventional stacks.

A method and apparatus for the formation of such spiral-shaped stack constitutes subject matter of the commonly assigned, copending United States application Ser. No. 578,357, filed May 6, 1975, entitled "METHOD AND APPARATUS FOR STACKING PRINTED PRODUCTS CONTINUOUSLY ARRIVING IN A SUBSTANTIALLY FISH SCALE OVERLAPPING ARRANGEMENT", listing as the inventors Walter Reist and Werner Honegger, the last-mentioned inventor being one of the co-inventors of this development, and to which reference may be readily had and the disclosure of which is incorporated herein by reference. In order to understand the underlying principles of the present invention it is not necessary to describe in detail the equipment and technique used for forming a spiral-shaped stack of printed products, particularly since the basic formation for such sprial-shaped stack of products will be readily evident from the showing of FIG. 1. Hence, only enough of the arrangement of the spiral-shaped stack will be discussed herein so that those skilled in the art will readily understand the underlying concepts of this development. With the spiral-shaped stack arrangement of products as shown in the formation of FIG. 1, it will be recognized that the fish scale or fanned arrangement of the printed products in the original fish scale stream of such printed products —in contrast to a conventional stack—has not been completely eliminated.

SUMMARY OF THE INVENTION

It is a primary object of the present invention to provide an apparatus of the previously mentioned type which is constructed in such a manner that with the use thereof a substantially spiral-shaped stack of articles can be directly again transformed into a fish scale stream of such articles without the need to previously individually separate the articles.

Another object of this invention aims at the provision of apparatus for forming a fish scale arrangement of products or articles from a substantially spiral-shaped arrangement of such products or articles in an extremely efficient, reliable and relatively high speed manner, the destacking of the spiral-shaped formed stack of products or articles being carried out without danger of damage thereto.

Now in order to implement these and still further objects of the invention, which will become more readily apparent as the description proceeds, the apparatus proposed by this development is manifested by the features that there is provided a stack support having a support surface means for the reception of the stack of products. Additionally, there is provided a rotary or rotational drive in order to place into rotation about the axis of the spiral the spiral-shaped formed stack of products supported upon the stack support. At the stack support there is provided a stationary opening or throughpassage following which there is arranged an outfeed or delivery conveyor.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE INVENTION

Figure 1:
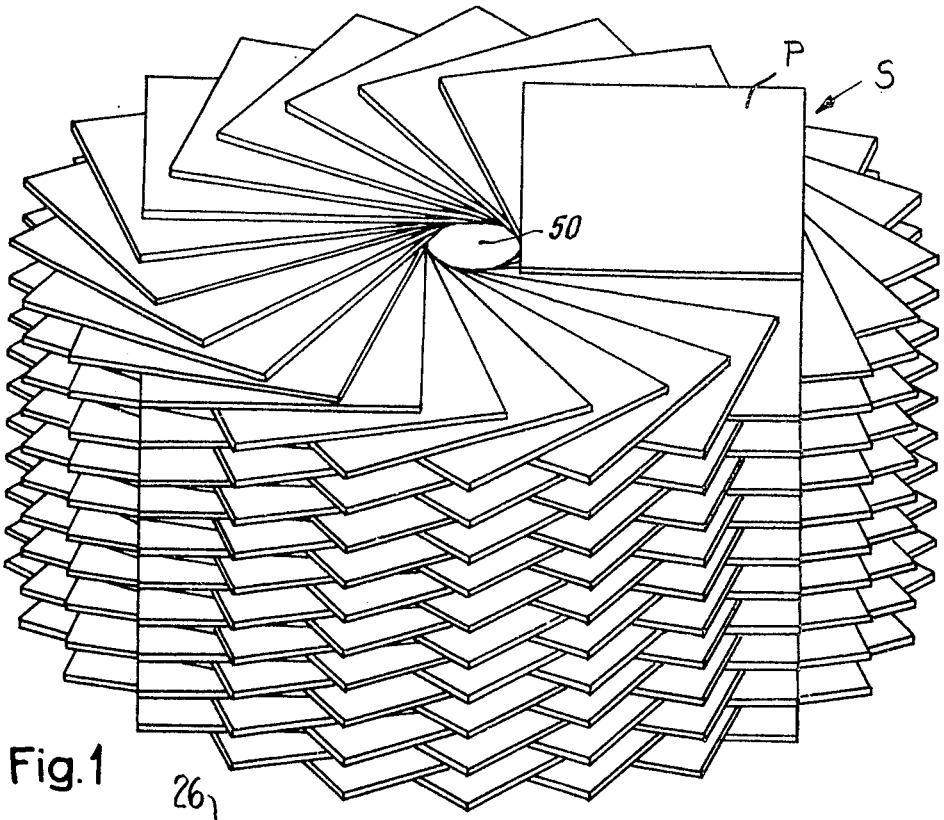
FIG. 1 is a perspective view of the previously mentioned substantially spiral-shaped formed stack of products, typically printed products, wherein such printed products bear against one another in partially overlapping arrangement.

Describing now the drawings, and referring to FIG. 1 it is to be recognized that the spiral-shaped formed stack S of articles or products, typically printed products such as newspapers, has been formed in the illustrated spiral-shaped configuration by suitable means, such as for instance the equipment disclosed in the aforementioned copending, commonly assigned United States application Ser. No. 578,357 to which reference may be readily had. Further, with respect to the showing of FIG. 1 it is to be mentioned that the illustrated spiral-shaped stack S has not been built-up to the maximum possible height, so as not to lose its inherent stability as an inherently stable structure, without the need to resort to the aid of auxiliary means. If it is assumed, as mentioned above, that the printed products P which are stacked in the stack S are constituted by folded printed products, for instance the aforementioned newspapers, then the printed products are preferably arranged in the stack in such a manner that the main fold bounds at the central, continuous opening 50 of the stack S.

Figure 2:
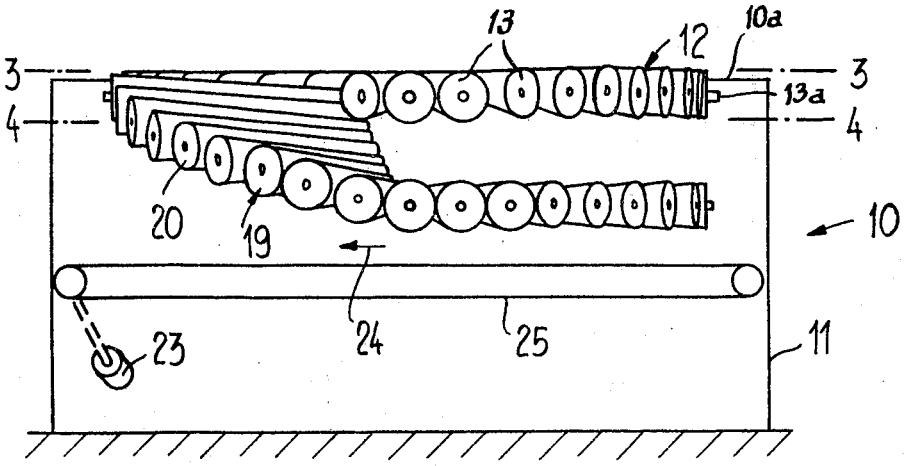
FIG. 2 is a schematic side view of an exemplary embodiment of apparatus designed according to the teachings of the present invention.
Figure 3:
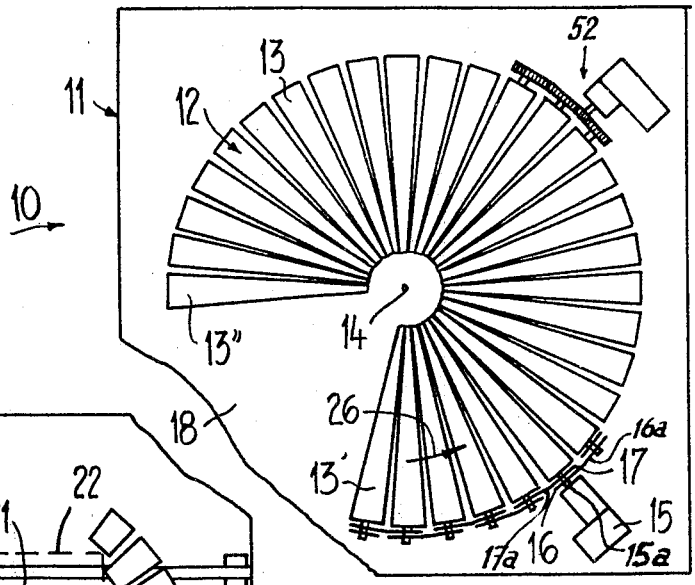
FIG. 3 is a plan view of the apparatus illustrated in FIG. 2 wherein as a matter of convenience in illustration there have only been shown therein the components which are disposed between the planes 3—3 and 4—4 of FIG. 2.
Figure 4:
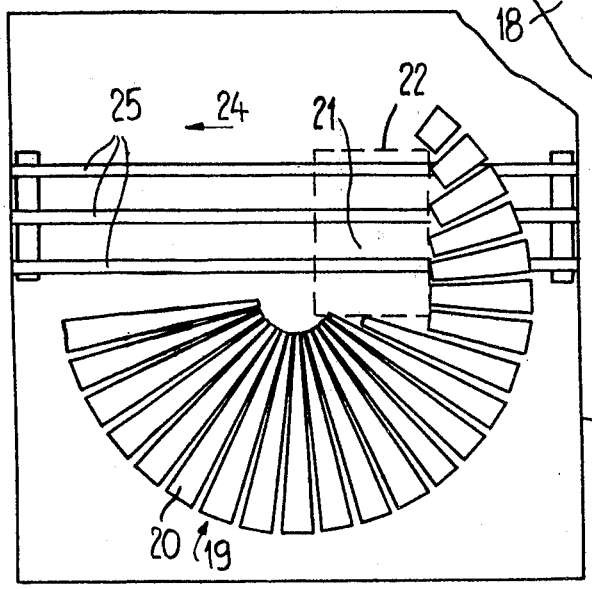
FIG. 4 is a plan view of the apparatus shown in FIG. 2 wherein there have only been schematically illustrated the elements which have not been shown in FIG. 3.

Turning now to the details of a preferred constructional embodiment of apparatus for destacking the spiral-shaped formed stack S of printed products P of FIG. 1, and by referring to FIGS. 2 to 4 it will be recognized that such apparatus 10 is provided with a schematically indicated frame 11 possessing an approximately square configuration in plan view, and the top or upper edge 10*a* of which for the most part is spanned by a substantially flat, circular ring-shaped roller track or roller arrangement 12 which describes i.e. extends through an angle of approximately 280°. This roller track 12 consists of a number of substantially conical rollers 13, in this instance assumed to be constituted by twenty-nine such conical rollers, as best seen by referring to FIG. 3. These rollers 13 are arranged to extend radially outwardly away from a center 14 in such a manner that the uppermost situated generatrix or surface line of each such roller is located in the plane 3—3 of FIG. 2. In other words, the lengthwise axes of the rollers 13 extend away from the center 14 so as to be slightly downwardly inclined, as best seen by referring to FIG. 2. The rollers 13 are rotatably mounted at both of their ends in any suitable manner, for instance with the aid of the journals 13*a* coacting with suitable bearings (not shown). The manner in which the rollers 13 are rotatably mounted is not in any way crucial, and thus any suitable means appropriate for this purpose can be utilized. As best seen by referring to FIG. 3, with the illustrated exemplary embodiment of apparatus, all of the rollers 13 of the roller track 12 are driven by a suitable drive motor 15. Drive motor 15 has a power take-off shaft 15a at which there is coupled a driven element, such as a sprocket gear 16 which, in turn, is rigidly connected for rotation with the one end of the rollers 13. Arranged coaxially with respect to the sprocket gear or wheel 16 and rigidly rotatably connected therewith is a further sprocket wheel or gear 17. Sprocket chains 16*a* and 17*a* extend from the sprocket gears 16 and 17, respectively, to the neighboring rollers 13 which are thus driven in the same rotational sense through the agency of an analogous pair of such sprocket gears 16, 17. Here also it is to be understood that different means can be used for driving the rollers 13 in the same rotational sense, for instance the rollers 13 of the roller track 12 also could be driven by a drive motor-gear train arrangement, generally indicated by reference character 52, as shown at the upper right-hand portion of the illustration of FIG. 3. What is only of importance is that all of the rollers 13 of the roller track 12 are driven in the same sense.

From what has been explained above it will be apparent that the roller track 12 forms a circular ring-sector-shaped stack support or carrier which encloses an angle of about 280°, and furthermore, between the first roller 13' and the last roller 13'' of the roller track 12 there is left free a likewise sector-shaped throughpassage or opening 18. In this regard attention is directed to FIG. 3.

As best seen by referring to FIGS. 2 and 4 a further roller track 19 merges with the last roller 13'' of the roller track 12. This further roller track 19, at least at its starting section, describes a spiral or helical surface. The rollers 20 of this roller track 19 are of the same construction as the rollers 13 of the roller track 12 at least in that section which describes the spiral or helical surface mentioned above and such rollers 20 are likewise driven in the same sense as the rollers 13 of the roller track 12. As a matter of convenience in illustration the drive means for the rollers 20 of the roller track 19 have been omitted from the drawing, but again any suitable drive means can be employed. With the illustrated exemplary embodiment the last nine rollers of the roller track 19 possess decreasing lengths, as best seen by referring to FIG. 4, so that in the conveyor path of the roller track 19 likewise possessing the shape of a circuiar ring-sector there is formed an essentially rectangular opening or recess 21, which has been indicated in FIG. 4 with the phantom or broken lines 22. From the illustration of the equipment depicted in FIG. 2 in combination with the showing of FIG. 4 it will be recognized that the last approximately fifteen rollers —including the shortened rollers—of the roller track 19 again define an essentially horizontal conveyor surface which is substantially parallel to the plane 3—3 of FIG. 2.

Continuing, it will be seen that beneath the roller track 19 there is arranged in the frame 11 a conveyor band 25 or equivalent structure, this conveyor band 25 being driven by means of a suitable drive motor 23 (FIG. 2) so as to move in the direction of the arrow 24. The conveying direction 24 of the conveyor band 25, as best seen by referring to FIG. 4, leads away from the recess or opening 21 of the roller track 19. Of course, a further conveyor band or any other suitable transport device can be connected downstream of the conveyor band 25 for transporting away the fish scale arrangement of the printed products.

The illustrated exemplary embodiment of apparatus, apart from the stack support formed by the roller track 12, also possesses an outfeed conveyor device or delivery transport mechanism which in this instance is formed by the roller track 19 with the thereat merging conveyor band 25 or the like.

Figure 5:
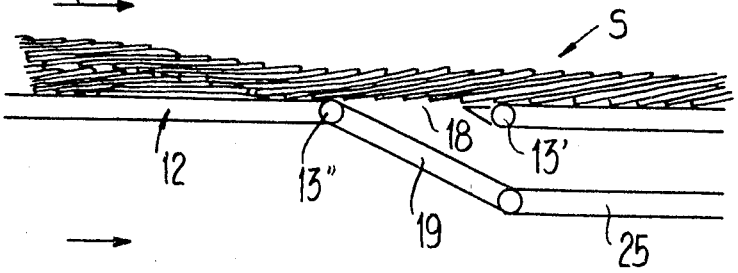
FIGS. 5, 6 and 7 respectively illustrate in development views three operating phases or steps of the apparatus of this development in order to clearly understand the mode of operation thereof.
Figure 6:
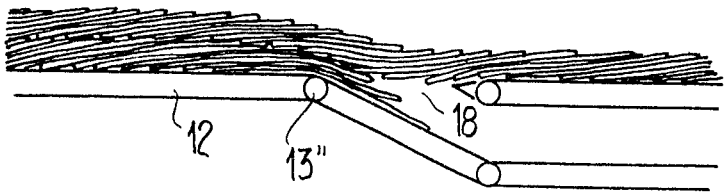
Figure 7:
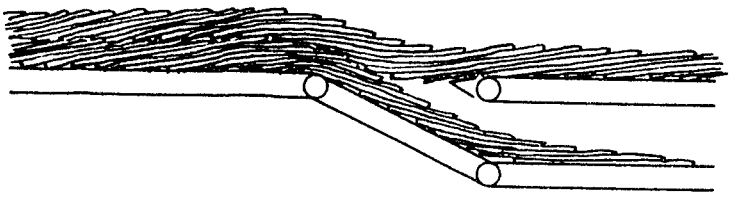

Having now had the benefit of the above description of the exemplary embodiment of apparatus its mode of operation will now be considered with respect to FIGS. 5 to 7. In such Figures there will be recognized —in development views—the roller track 12 (here illustrated as a conveyor band), the roller track 19 which merges with the last roller 13'' of the roller track 12 (and which roller track 19 is likewise illustrated as a conveyor band), and the conveyor band 25 merging with the roller track 19. There will be likewise recognized the start of the lowermost and a part of the second lowermost "coil" or "helix" of the stack S, which in this case, since the illustrations of FIGS. 5 to 7 are development views, appear as superimposed fish scale stream arrangement of products. If it is imagined that the stack S is placed into rotation in the direction of the arrow 26 (cf. also FIG. 3), then it will be apparent from the showing of FIGS. 5 to 7 that only that printed product can depart through the opening or throughpassage 18, the leading edge of which is not supported by the trailing section of a preceding printed product. Thus, as shown in FIG. 5, the printed products in the second coil or helix of the spiral-shaped stack S, which are located just over the throughpassage 18, accordingly do not fall through such throughpassage. Only when the first printed product of the first coil or helix of the stack has arrived over the roller 13'' of the roller track 12 then such —also assisted by the pressure of the printed products situated thereabove—will be able to pass through the throughpassage or opening 18 and arrive at the roller track 19 where it is further rotated until it arrives at the recess or opening 21 by means of which its end can drop onto the conveyor band 25. This operation has been schematically illustrated in FIG. 6. Once the start of the first coil or helix of the stack has moved through the throughpassage or opening 18, then the entire stack S will be unwound, coil after coil, and from the spiral-shaped stack there is again formed at the conveyor band 25 a fish scale product stream.

Although with the illustrated exemplary embodiment of apparatus both the roller track 12 and also the roller track 19 possess driven rollers as previously explained, it should be apparent that such rollers also could be simply freely rotatable rollers. In that instance the means for placing the stack S into rotation would have to engage at the stack itself. This could be achieved, by way of example, in that there is placed a preferably round or circular weighting body (not shown) upon the upper end face of the stack S, i.e. the side visible in the showing of FIG. 1, and at which then there would operatively engage the rotational drive.

Additionally, instead of the roller tracks 12 and 19 there could be provided curved conveyor bands or tracks formed of small rollers which, in turn, again can be driven or, however, also arranged to be simply freely movable or rotatable respectively.

Moreover, it is to be here mentioned that the roller track 12 or equivalent structure forms a circular ring-sector-shaped stack support which extends through an angle in the order of approximately between 270° and 300°. Further, as concerns the further roller track 19 or equivalent structure the rollers 20 thereof which are of decreasing length advantageously have their ends possessing the smaller end surface located essentially in a plane extending transversely with respect to the direction of conveying of the linear conveyor band 25, as best seen by referring to FIG. 4.

One of the more notable advantages of the illustrated and described exemplary embodiment of apparatus of this development —of course in conjunction with a spiral-shaped stack—resides in the fact that the printed products can be directly transferred from a stacked condition again into a fish scale stream arrangement, and the printed products practically no longer experience any appreciable acceleration. They are simply transferred from a practically circular-shaped path of travel tangentially to a linearly extending conveyor band or equivalent conveying device, without the need to initially separate such printed products.

While there is shown and described present preferred embodiments of the invention, it is to be distinctly understood that the invention is not limited thereto, but may be otherwise variously embodied and practiced within the scope of the following claims. Accordingly,

What is claimed is:

1. An apparatus for destacking a stack of printed products in a substantially spiral-shaped configuration comprising successive contiguous coils of printed products, each coil having neighboring printed products partially overlapping one another, comprising stack support means including support surface means located substantially in a single plane for receiving the spiral-shaped configuration of printed products, said stack support means being provided with a stationary throughpassage opening, rotational drive means for placing into rotation the spiral-shaped configuration of printed products which are supported upon the stack support means about the lengthwise axis of the spiral and for successively feeding the coils from the stack beginning with the lowermost coil from the bottom end of the stack through the stationary throughpassage opening, and outfeed conveyor means arranged subsequently of said stationary throughpassage opening.

2. The apparatus as defined in claim 1, wherein said stack support means forms a support in the form of a sector of a substantially circular ring and serving to support the stack in coaxial relative position.

3. An apparatus for destacking a substantially spiral-shaped formed stack of printed products, the printed products partially bearing against one another in overlapping formation, comprising stack support means including support surface means for receiving the spiral-shaped formed stack of printed products, rotational drive means for placing into rotation the spiral-shaped formed stack of printed products which are supported upon the stack support means about the lengthwise axis of the spiral, said stack support means being provided with a stationary throughpassage opening, outfeed conveyor means arranged after said stationary throughpassage opening, said stack support means comprises a substantially flat roller track, said roller track being constituted by substantially radially extending conical roller elements arranged in a substantially circular ring configuration.

4. The apparatus as defined in claim 3, said rotational drive means including drive means for driving said roller elements.

5. The apparatus as defined in claim 2, wherein said sector of said substantially circular ring encloses an angle in the order of approximately between 270° and 300°.

6. An apparatus for destacking a substantially spiral-shaped formed stack of printed products, the printed products partially bearing against one another in overlapping formation, comprising stack support means including support surface means for receiving the spiral-shaped formed stack of printed products, rotational drive means for placing into rotation the spiral-shaped formed stack of printed products which are supported upon the stack support means about the lengthwise axis of the spiral, said stack support means being provided with a stationary throughpassage opening, outfeed conveyor means arranged after said stationary throughpassage opening, said stack support means forming a support in the form of a sector of a substantially circular ring and serving to support the stack in coaxial relative position, said stack support means comprises a first flat roller track possessing substantially radially extending conical roller elements arranged in a substantially circular ring, and a second roller track describing a substantially spiral surface and possessing conical roller elements which are radially arranged with respect to the center of the circular ring, said second roller track merging at the last roller element of the first roller track viewed in the direction of rotation brought about by said rotational drive means.

7. The apparatus as defined in claim 6, wherein at least a part of the roller elements of the second roller track describing a spiral surface are driven in the same sense as the roller elements of the first roller track.

8. The apparatus as defined in claim 6, wherein a substantially linear conveyor band defining said outfeed conveyor means is arranged after said second roller track.

9. The apparatus as defined in claim 8, wherein at least some of the roller elements of the second roller track at the region of the end of said second roller track are reduced in length, said reduced length roller elements having the ends thereof possessing the smaller end surfaces disposed essentially in a plane extending transversely with respect to the direction of conveying of the linear conveyor band.

* * * * *